United States Patent [19]

Hostetler

[11] 4,420,372

[45] Dec. 13, 1983

[54] HIGH BULK PAPERMAKING SYSTEM

[75] Inventor: Ronald E. Hostetler, Vancouver, Wash.

[73] Assignee: Crown Zellerbach Corporation, San Francisco, Calif.

[21] Appl. No.: 396,994

[22] Filed: Jul. 12, 1982

Related U.S. Application Data

[62] Division of Ser. No. 322,109, Nov. 16, 1981, Pat. No. 4,356,059.

[51] Int. Cl.[3] ..... B31F 1/12

[52] U.S. Cl. ..... 162/280; 162/281; 162/359; 162/360

[58] Field of Search ..... 162/111, 112, 113, 117, 162/206, 207, 306, 359, 358, 360, 280, 281

[56] References Cited

U.S. PATENT DOCUMENTS

| | | | |
|---|---|---|---|
| 2,744,453 | 5/1956 | Hornbostel | 162/359 |
| 4,196,045 | 4/1980 | Ogden | 162/359 |
| 4,309,246 | 1/1982 | Hulit et al. | 162/113 |

FOREIGN PATENT DOCUMENTS

| | | | |
|---|---|---|---|
| 586264 | 11/1959 | Canada | 162/359 |
| 45-35366 | 11/1970 | Japan | 162/281 |

*Primary Examiner*—Peter Chin

*Attorney, Agent, or Firm*—Thomas R. Lampe

[57] ABSTRACT

A system for producing a bulky, soft and absorbent paper web wherein the web is creped from a first creping surface, passes through a nip formed between a dewatering felt and imprinting fabric of a specified character and is applied to and creped from a second creping surface.

4 Claims, 2 Drawing Figures

HIGH BULK PAPERMAKING SYSTEM

This application is a division of application Ser. No. 06/322,109, filed Nov. 16, 1981 now U.S. Pat. No. 4,356,059.

BACKGROUND OF INVENTION

1. Field of Invention

This invention relates to a method and apparatus for manufacturing a bulky, soft and absorbent paper web.

2. Description of the Prior Art

U.S. patent application Ser. No. 933,203 Hulit, et al., filed Aug. 14, 1978, relates to a system for producing a bulky, soft and absorbent paper web using mechanical means to predry the web. The structure for predrying the web includes a papermaker's felt and imprinting fabric of a specific character and a pair of opposed rolls creating a compression nip defined by the fabric and felt through which the web is passed and partially dewatered. According to the aforesaid application, the web prior to entering the fabric-felt compression nip is essentially uncompacted and the fabric-felt arrangement comprises the initial predrying stage in the system. Since the imprinting fabric then carries the predried web in undisturbed condition to a Yankee dryer or other component defining a heated drying surface, the only significant compacting of the web that occurs in the system of the aforesaid application is at the location of the compaction elements or knuckles of the imprinting fabric. As a consequence, a soft, bulky and absorbent sheet is produced through use of the system covered thereby.

U.S. patent application Ser. No. 280,752, R. E. Hostetler, filed July 6, 1981, also relates to a system for producing a bulky, soft and absorbent paper web. In accordance with the teachings of this latter application a wet web of principally lignocellulosic fibers is positioned on a first dewatering felt and then conveyed by the felt through a first nip formed by it and a second dewatering felt to remove water from the web. The partially dewatered web is then conveyed to a second nip formed between a dewatering felt and an open mesh imprinting fabric formed of woven filaments, the fabric having spaced compaction elements and defining voids between the filaments. While the partially dewatered web is in the second nip, it is impressed against the fabric by the felt to force a predetermined portion of the web into the voids and provide bulk thereto. The web is then retained on the imprinting fabric after the web passes through the second nip and removed therefrom before final drying by applying the web to a creping surface at a third nip location, the third nip being formed between the creping surface and the imprinting fabric. The web is retained on the imprinting fabric in an essentially undisturbed condition during retention and transport thereof on the imprinting fabric between the second and third nips.

BRIEF SUMMARY OF THE INVENTION

The present invention also relates to a system for manufacturing a bulky, soft and absorbent paper web, and in common with the inventions covered by the two aforesaid applications, the present system utilizes an imprinting fabric to felt press in a stage of its operation. As compared to such prior art arrangements, however, the current system also incorporates two rotatable dryer means having smooth heated surfaces to which the web is applied and is removed therefrom in serial fashion after passing through the imprinting fabric-felt press. Specifically, the wet paper web is applied to the surface of the first rotatable dryer means, compacted substantially overall while on the surface, and removed therefrom. The partially dewatered web is then introduced into a wet embossing nip formed between a felt and an open mesh imprinting fabric formed of woven filaments having spaced compaction elements and defining voids between the filaments. While the web is in the wet embossing nip it is impressed against the fabric whereby from about 5% to about 50% of the web will be compacted by the compaction elements and from about 50% to 95% of the web will be impressed into the voids. The web is retained on the imprinting fabric after passing through the wet embossing nip and is transported by the fabric into contact with a heated surface of a second rotatable dryer means. The web is then dry creped from the second heated surface. Through utilization of this system, a high bulk, low density dry creped tissue is produced and drying costs minimized.

DETAILED DESCRIPTION

Figure 1:
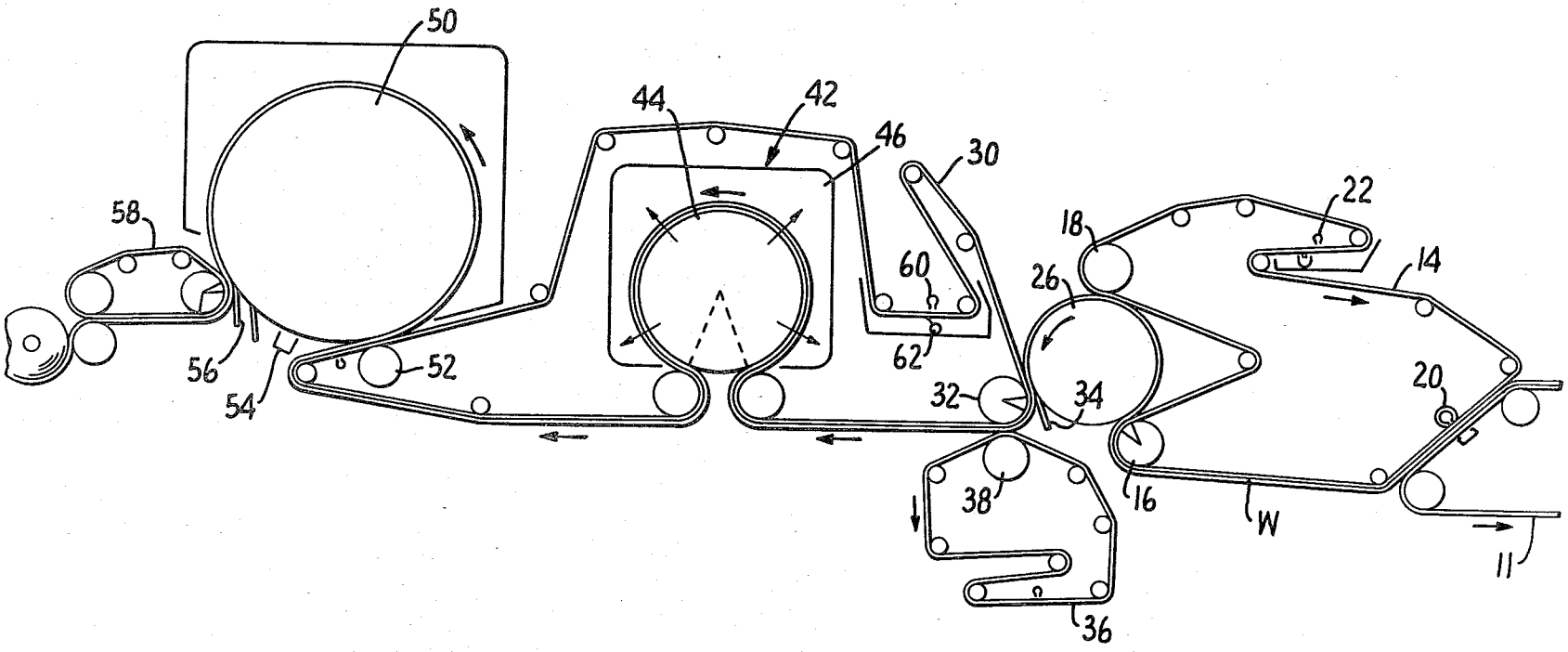
FIG. 1 is a schematic side view of a preferred form of apparatus constructed in accordance with the teachings of the present invention and for carrying out the method thereof.

Referring now to FIG. 1, a papermaking machine constructed in accordance with the teachings of the present invention is illustrated. The machine includes a paper web-forming device of any suitable type such as a Fourdrinier machine, the Fourdrinier wire 11 of which is illustrated. The Fourdrinier wire delivers the wet web W (normally in the order of from about 7% to about 23% solids) to a pick-up felt 14 forming an endless loop about a plurality of rollers including a suction pressure roll 16 and a blinded drilled pressure roll 18. Web pick-up by the felt may be facilitated through use of a steam box arrangement under the wire at the vacuum slot pick-up 20. Preferably a water shower 22 and uhle box combination are provided to clean and condition the felt prior to web pick-up.

Felt 14 forms a nip with a rotatable dryer can 26 which is heated by steam or other means and has a smooth solid outer surface. Transfer of the web W takes place at the location of suction pressure roll 16 so that roll 16 and the dryer can compact the web overall. While on the dryer can the web also passes through a nip defined by the pick-up felt and the dryer can in the vicinity of pressure roll 18. From that second nip continued rotation of the dryer can brings the web into contact with an imprinting fabric 30 looped about a roll 32 which may be plain or suction. Closely adjacent to roll 32 the web W is removed from dryer can 26 by a skinning doctor 34 and the web is applied to the imprinting fabric 30.

U.S. patent application Ser. No. 933,203 Hulit et al., filed Aug. 14, 1978, may be referred to for details of an imprinting fabric preferred for use in connection with the present invention. Specifically the imprinting fabric disclosed therein is an open mesh fabric formed of woven filaments. The fabric has compaction elements defined by the knuckles formed at the warp and weft crossover points of the fabric filaments and defines voids between the filaments. The imprinting fabric has a surface void volume of from about 15 cc/m$^2$ to about 250 cc/m$^2$ and preferably from about 40 cc/m$^2$ to about 150 cc/m$^2$. The compaction element area of the imprinting fabric constitutes between about 5% and about 50%, and preferably from about 20% to about 35%, of the total web supporting surface area of the fabric.

Imprinting fabric 30 is in the form of a continuous loop rotating in a clockwise manner as viewed in FIG. 1. At the time the partially dewatered web is applied to the imprinting fabric 30 it has an overall fiber consistency of from about 40% to about 50%. The partially dewatered web then passes through a nip formed between the imprinting fabric and a papermaker's dewatering felt 36 also in the form of a continuous loop and moving in a counterclockwise manner as viewed in FIG. 1. A pressure roll 38 is in opposition to roll 32 to provide the desired nip pressure between the felt 36 and fabric 30. The imprinting fabric-felt press just described serves to increase the apparent bulk of web W by impressing from about 50% to 95% of the web into the voids of the imprinting fabric with the only significant compaction of the web taking place in the vicinity of the compaction elements. As noted in the aforesaid Hulit et al. application, an imprinting fabric of the type just described will retain the wet paper web impressed therein by the papermakers' dewatering felt after passing through the nip formed by these two elements.

The web W is now transferred to a through dryer 42 comprising a rotatable perforated dryer drum 44 and an outer hood 46 which receives the pressurized hot air or other heated fluid from the rotatable perforated drum in the conventional manner. The imprinting fabric 30 is looped about the perforated dryer drum 44 so that the web W passes about almost the entire circumference of the dryer drum sandwiched between the drum outer surface the imprinting fabric. After the web has passed through the through dryer it has an overall fiber consistency generally equal to or greater than 80% solids.

The web is then transported by imprinting fabric 30 to a Yankee dryer 50 and applied to the smooth heated outer creping surface thereof. Transfer to the Yankee takes place at the location of a solid Yankee pressure roll 52 with transfer to the creping surface preferably being facilitated by the application of a suitable adhesive, such as animal glue, to the Yankee surface or web by any suitable adhesive applicator 54 just prior to engagement of the web W with the Yankee creping surface. After being rotated about the Yankee drum the web is creped therefrom by a creping blade 56 and transferred to a suitable winding mechanism. As the imprinting fabric continues its travel from the Yankee back to the dryer can, it is cleaned as by means of a vacuum box 60 and air jet 62. The air jet may also be utilized to apply a spray of release agent such as emulsified mineral oil in water to the imprinting fabric.

Figure 2:
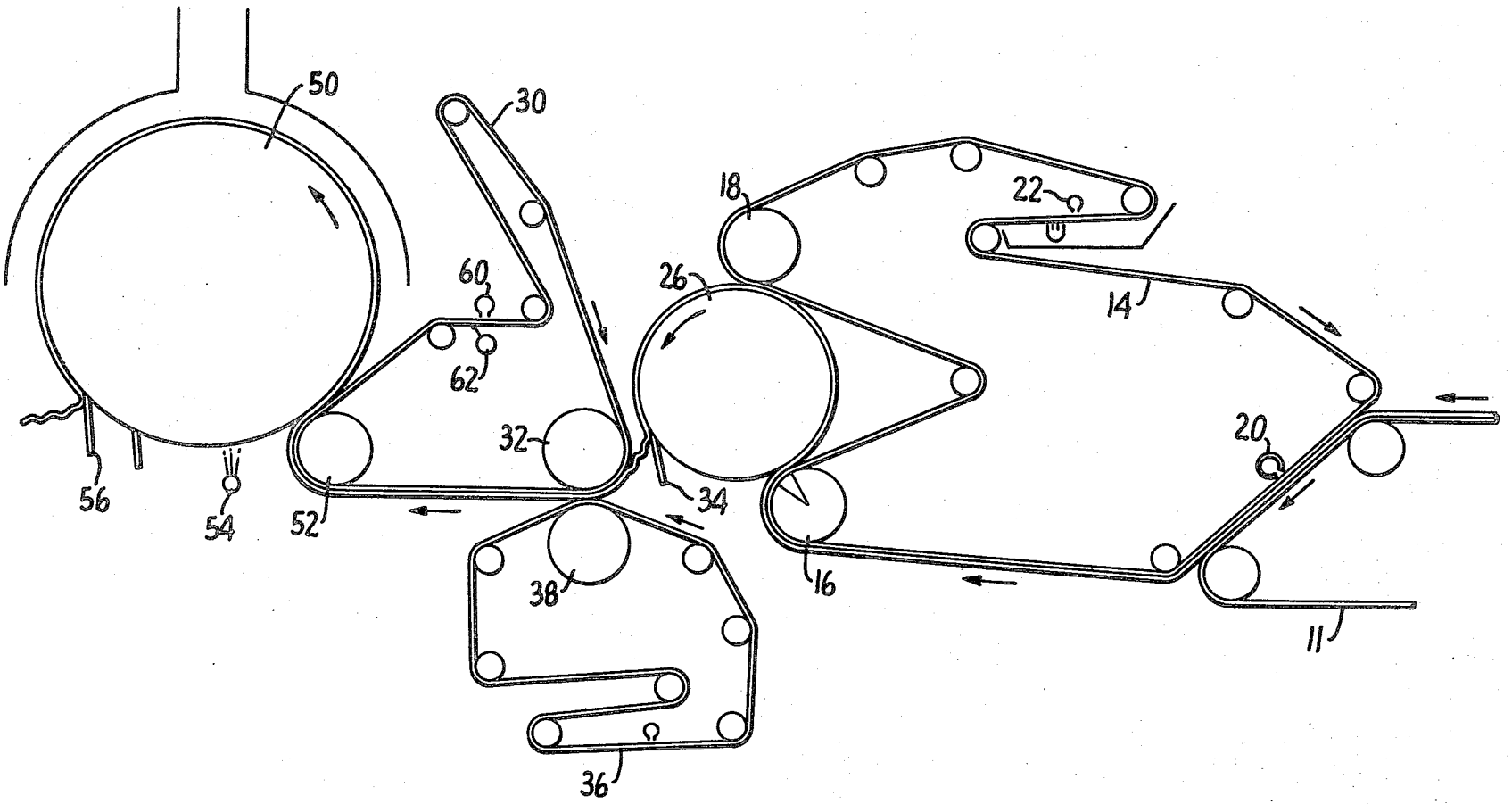
FIG. 2 is a view similar to that of FIG. 1 but illustrating an alternative form of apparatus.

FIG. 2 illustrates in schematic fashion an alternative form of papermaking machine layout incorporating the teachings of the present invention. The arrangement is in most respects identical to the arrangement of FIG. 1 and for this reason like components have been designated by the same reference numerals employed with respect to the FIG. 1 embodiment. The principal difference of this configuration as compared to that of FIG. 1 resides in the elimination of a through air dryer in the arrangement. Rather than proceed through a through dryer the imprinting fabric 30 transfers the web directly to the creping surface of the Yankee 50. It is obvious that the web W will be much wetter (in the order of 40–50% solids) when applied to the Yankee surface in FIG. 2 than is the case in the FIG. 1 embodiment. For this reason, the drying capacity of the Yankee 50 in FIG. 2 must be much greater, requiring either a larger Yankee or a reduction in web speed. Another difference resides in the fact there is an open draw between roll 32 and dryer can 26. This open draw arrangement could also be utilized in connection with the system of FIG. 1.

I claim:

1. Apparatus for manufacturing a bulky, soft and absorbent paper web comprising:

first rotatable dryer means having a smooth heated surface;

web delivery means defining a nip with said first dryer means and cooperable therewith to compact said web substantially overall and apply said web to said first dryer means surface;

web doctoring means for doctoring said web from said first dryer means surface;

a press means for receiving said web from said first drying means surface, said press means defined by a dewatering felt loop and an open mesh imprinting fabric loop formed of woven filaments having spaced compaction elements and defining voids between the filaments said compaction elements constitute at least about 5% of the total web supporting surface of said imprinting fabric; and second rotatable dryer means having a smooth heated creping surface and web doctoring means for doctoring said web from said second dryer means surface, said imprinting fabric extending between said press and said creping surface of said second dryer means and defining a nip with the creping surface whereby said web is delivered from said press to said creping surface in essentially undisturbed condition and applied to said creping surface.

2. The apparatus of claim 1 additionally comprising a through dryer disposed between said first rotatable dryer means and said second rotatable dryer means, said imprinting fabric placing said web into operative engagement with said through dryer as it is transported between said rotatable dryer means.

3. The apparatus of claim 2 wherein said through dryer comprises a rotatable dryer drum having a foraminous outer surface, said imprinting fabric extending partially about the periphery of said dryer drum to sandwich said web between said foraminous outer surface and said imprinting fabric.

4. The apparatus of claim 1 additionally comprising means cooperable with said first dryer means to compact said web overall at a plurality of locations on said first dryer means heated surface.

* * * * *